United States Patent [19]

Fedder

[11] 4,341,455

[45] Jul. 27, 1982

[54] CONDUCTING TONER TRANSFER APPARATUS

[75] Inventor: Richard C. Fedder, Longwood, Fla.

[73] Assignee: Burroughs Corporation, Orlando, Fla.

[21] Appl. No.: 93,219

[22] Filed: Nov. 13, 1979

[51] Int. Cl.[3] ..... G03G 15/00

[52] U.S. Cl. ..... 355/3 TR; 355/3 FU

[58] Field of Search ..... 355/3 TR, 3 TE, 3 FU, 355/3 R, 11, 15; 15/1.5 R, 256.5

[56] References Cited

U.S. PATENT DOCUMENTS

| | | | |
|---|---|---|---|
| 2,751,616 | 6/1956 | Turner et al. | 15/1.5 R |
| 3,526,457 | 9/1970 | Dimond et al. | 355/15 |
| 3,712,734 | 1/1973 | Jovanovic | 355/15 |
| 3,893,761 | 7/1975 | Buchan et al. | 355/3 TR |
| 3,947,113 | 3/1976 | Buchan et al. | 355/3 TR |
| 4,144,808 | 3/1979 | Iwasa et al. | 355/3 TR |
| 4,187,774 | 2/1980 | Iwasa et al. | 355/3 TR |
| 4,195,927 | 4/1980 | Fotland et al. | 355/3 TR |
| 4,207,101 | 6/1980 | Vola et al. | 355/3 TR |

*Primary Examiner*—R. L. Moses

*Attorney, Agent, or Firm*—Carl Fissell, Jr.; K. R. Peterson; David Rasmussen

[57] ABSTRACT

Novel apparatus for transferring magnetic and conducting toner from a dielectric surface to plain paper by interposing a dielectric belt mechanism between the dielectric surface of an imaging drum and a plain paper substrate such that the toner is first transferred to the dielectric belt and subsequently transferred to a plain paper in a fusing station. Operably associated cleaning and discharging of the dielectric belt is provided.

1 Claim, 1 Drawing Figure

CONDUCTING TONER TRANSFER APPARATUS

BACKGROUND OF THE INVENTION

1. Field of the Invention

The present invention relates to electrographic apparatus for use as a copying device and more specifically to a novel toner transfer technique as embodied in copying apparatus.

2. Description of the Prior Art

Prior art apparatus for use in electrographic copying devices utilizing magnetic and conductive toner wherein the toner is transferred to plain paper do not produce a high percentage of toner transfer. In the usual and well-known electrostatic transfer process a corona wire or semi-conductive roller provides an electric field for transferring the charged toner particles. However, at high relative humidity the electric field across the paper and toner decays fairly rapidly resulting in poor toner transfer. In addition, electric charges can be transferred to the conductive toner particles and cause the particles to blow around when their charge is reversed.

SUMMARY OF THE INVENTION

The present invention solves these and other problems in a new, novel and heretofore unobvious manner by first selectively applying conductive and magnetic toner to the dielectric surface of a recording drum. Thereafter, the conductive and magnetic toner is transferred to a dielectric film overlay on a semiconducting belt by applying a suitable electric potential between the semi-conducting belt and the drum. Finally, the image of toner particles is transferred to plain paper which is moved between the belt and fusing means to produce clear, dense copy. A moistened felt wiper cloth cleans the dielectric belt of toner and charge before returning to the transfer point.

BRIEF DESCRIPTION OF THE DRAWING

The single FIGURE of drawing is a schematic representation of apparatus embodying the present invention.

DETAILED DESCRIPTION OF A PREFERRED EMBODIMENT OF THE PRESENT INVENTION

Figure 1:
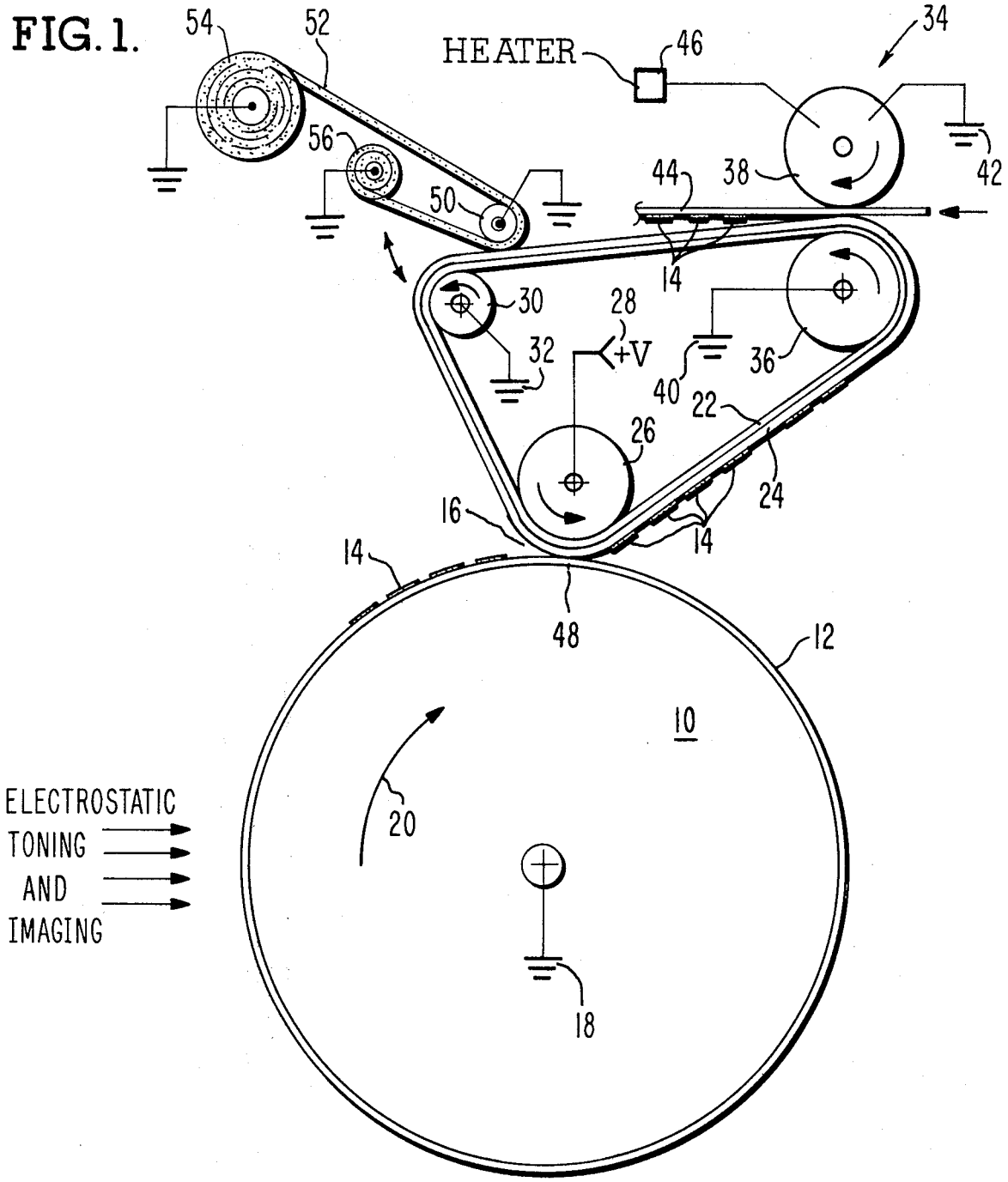

Earlier known methods and apparatus for transferring magnetic and conductive toner to plain paper do not produce a high percentage of toner transfer. In the familiar electrostatic transfer process a corona wire or semi-conductor roller provides an electric field for transferring the charged toner particles. At high relative humidity the electric field across the paper and toner decays fairly rapidly causing poor transfer. Also charge can be transferred to the conductive toner particles themselves and cause the particles to blow around when their charge is reversed.

The present invention utilizes an aluminum drum 10 having a dielectric coating 12 thereon. Charged toner particles 14 from a source (not shown) are deposited on the dielectric surface 12 of drum 10 by means of electrostatic toning or imaging as shown to form an intelligible information image 16. Drum 10 is maintained at ground potential as seen at 18 and is rotated in the direction of arrow 20 by suitable conventional means (not shown).

Adjacent to drum 10 and in surface contact therewith is semi-conducting belt 22 covered with a highly insulating dielectric film 24. Dielectric film 24 is preferably a material such as teflon or polyethylene to which toner particles will not stick as they are fused in the heat-fuser station 34. Belt 22 is carried by three conductive rollers arranged within the belt loop and offset from one another so as to provide sufficient tension to keep the belt 22 stretched taut.

Roller 26, parallel to the axis of drum 10 and connected to a source of high electrical potential 28, acts to press belt 22 lightly into contact with the periphery of drum 10 as drum is revolved by means not shown.

Roller 30 offset to the left and slightly above roller 28 is employed to adjustably apply tension to belt 22 in the direction of the two-headed arrow shown. Roller 30 is maintained at ground potential with respect to roller 26 as indicated at 32.

To the right and above rollers 26 and 30 is provided a heat-fusing station 34 consisting of lower roller 36 located within the rightward loop of belt 22 and upper external roller 38 disposed above and axially parallel to roller 36. Rollers 36 and 38 are disposed in confronting relationship, and maintained at ground potential as indicated at 40 and 42.

A secondary substrate, such for example as plain paper 44 may be fed between upper roller 38 and belt 22 and roller 36, taking advantage of heat applied to roller 38 from heater 46 and the pressure developed between the two confronting rollers 36 and 38 as the paper 44 moves therebetween.

In operation of the device an image of desired information is produced on drum 12 by means for example of electrostatic toning. Magnetic and conductive toner 14 from a source (not shown) is applied to the dielectric surface 12 of drum 10 as drum 10 is rotated in the direction of arrow 20.

Electrostatic transfer of toner 14 from drum 10 to the dielectric layer 24 of belt 22 at the point of contact 48 between the dielectric layer 24 and drum 10 results from the high voltage bias potential applied to roller 26 with drum 10 at ground potential. High electric fields can be maintained on the toner particles 14 because of the highly insulating nature of the film on the dielectric belt 22. In addition, since the toner particles cannot reverse their charge the toner "blowoff" problem is alleviated.

Toner particles 14 are carried by dielectric belt 22 upwardly (rightwardly in the drawing) to the fusing station 34. At that point, introduction of plain paper 44 into the nip between the two confronting rollers 36 and 38 enables the toner to be transferred from belt 22 to the paper 44 under heat and pressure causing the toner to fuse to the paper in a clean, clear, crisp image.

Excess toner and charge are removed from the dielectric layer 24 of belt 22 by a slightly conductive felt belt 52 that is supplied from grounded roll 56 and passes over grounded roll 50 which presses the cloth belt into contact with the dielectric layer 24. The used felt belt is taken up on grounded roller 54.

What is claimed is:

1. Magnetic conductive toner transfer apparatus comprising, an imaging device having an image receiving dielectric surface on which an electrostatic toned image is accepted and carried, semi-conducting means carrying a highly insulating dielectric film disposed in surface contact with the dielectric surface of said imaging device, means operably associated with said imaging device and said semi-conducting means for applying an electrical potential to said last named means, means moveable relative to said semi-conducting means to keep said semi-conducting means taut with respect to the surface of the imaging device;

said semi-conducting means comprising an endless loop or belt and tensioning rollers maintained at ground potential and a transfer roller having a relatively high voltage potential applied thereto;

a toner fusing station to which said semi-conducting means is continuously moved, said fusing station including a first pressure roller operably associated with said semi-conducting means and a second pressure roller in confronting surface contact with said semi-conducting means and said first pressure roller;

heater means operably associated with said second pressure roller effective when energized to cause toner to fuse under pressure and heat to a secondary substrate such as paper which may be introduced into the nip between said first and second rollers to receive a toned and fixed image corresponding to the image carried by said imaging device; and continuously renewable means for removing toner and charge from said dielectric film by bringing unused means into cleaning contact with said film.

* * * * *